US005168914A

United States Patent [19]

Keller

[11] Patent Number: 5,168,914

[45] Date of Patent: Dec. 8, 1992

[54] AUTOMATIC JAMB LATCH MECHANISM FOR OVERHEAD BIFOLD DOOR

[75] Inventor: Daniel N. Keller, River Falls, Wis.

[73] Assignee: Hi-Fold Door Corporation, Elkhart Lake, Wis.

[21] Appl. No.: 653,770

[22] Filed: Feb. 11, 1991

[51] Int. Cl.[5] ..... E05D 15/26

[52] U.S. Cl. ..... 160/207; 160/213; 292/45; 292/48; 292/201

[58] Field of Search ..... 160/207, 213, 206, 188, 160/189, 193; 292/201, 45, 48

[56] References Cited

U.S. PATENT DOCUMENTS 3,024,838 3/1962 Egleston et al. .
3,504,729 4/1970 Alton .
4,088,172 5/1978 Pollock .
4,177,854 12/1979 DeVore .
4,243,091 1/1981 DeVore .
4,545,418 10/1985 List et al. .
4,609,027 9/1986 Keller .
4,637,446 1/1987 McQueen et al. .
4,903,747 2/1990 Johnson .

*Primary Examiner*—David M. Purol
*Attorney, Agent, or Firm*—Moore & Hansen

[57] ABSTRACT

A latch assembly for overhead bifold doors. The latch assembly is operated by the same manual or powered winch mechanism that is used to open and close the overhead bifold door. A latch assembly may be mounted to one or both ends of the overhead bifold door, and includes a latch arm that is moved to a latching position at the end of the door closing cycle. A latch member is fixedly positioned to the door jamb adjacent the latch assembly, and when the latch arm is drawn down, the latch member is located between it and the overhead bifold door, causing the overhead bifold door to be securely latched in its closed position until the winch mechanism is activated to begin the overhead bifold door opening cycle.

24 Claims, 3 Drawing Sheets

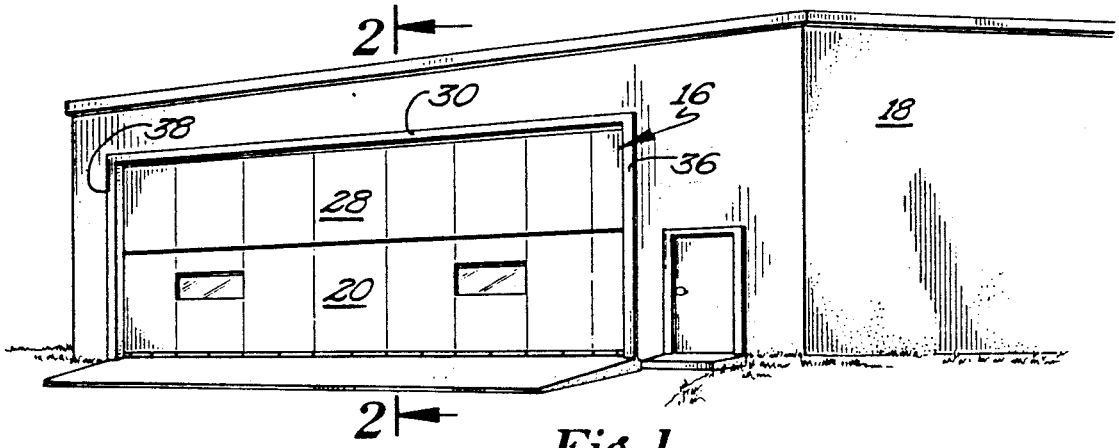
Fig 1
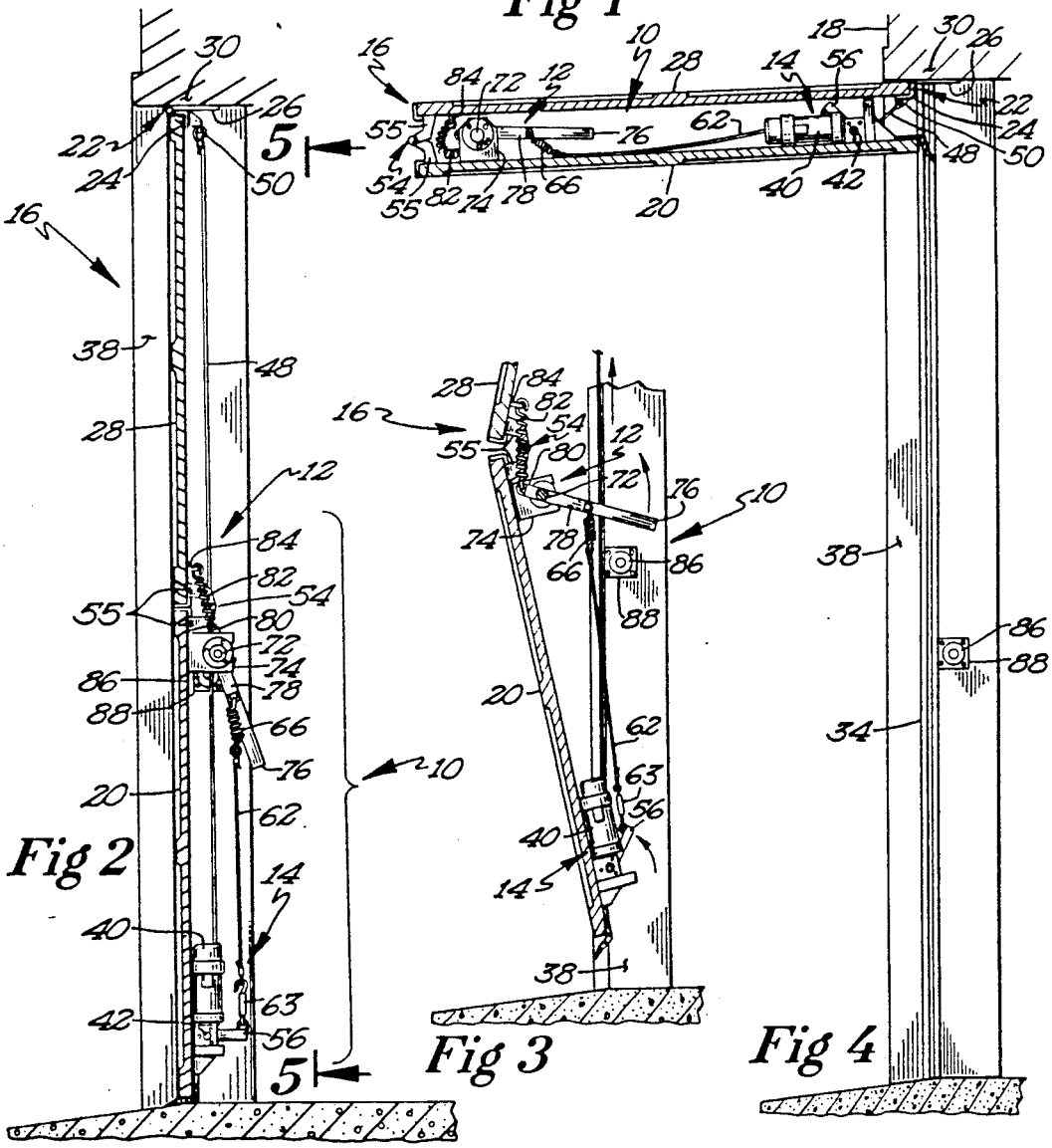
Fig 2
Fig 3
Fig 4

AUTOMATIC JAMB LATCH MECHANISM FOR OVERHEAD BIFOLD DOOR

BACKGROUND OF THE INVENTION

1. Technical Field

The present invention relates generally to latching mechanisms for overhead doors, particularly for those overhead doors with a bifold construction.

2. Background Information

A typical overhead bifold door assembly, such as that described in U.S. Pat. No. 4,609,027, issued to Keller on Sep. 2, 1986, includes an upper door panel and a lower door panel, with the upper door panel hingedly connected to the lintel or header of the door frame. When in its first, closed position, the panels of the overhead door are vertically aligned and cooperate to close the doorway, while in its second, open position the panels of the overhead door are in a folded, generally horizontal, parallel relation. Generally, a door of the size contemplated by the present invention is movable by a winch mounted to the lower door panel, with the winch having a cable extending to a fixed location above the doorway for vertically raising and lowering the bottom edge of the lower door panel and bringing the overhead door to its closed position.

Various systems have been developed to address the need for a locking mechanism that will securely lock the panels in their closed, vertically aligned position. In the above-mentioned U.S. Pat. No. 4,609,027 issued to Keller, the weight of the motor and winch mounted on the lower door panel were relied on to act as an anchor to provide dead weight to help keep the door closed. However, such an arrangement would not necessarily provide the affirmative latching action desired to maintain securely the overhead door in its closed position.

An example of a latching system is disclosed in U.S. Pat. No. 4,903,747 issued to Johnson on Feb. 27, 1990. The system disclosed in this patent, however, is directed to a device usable with a pair of relatively small, vertically disposed left and right bifold door assemblies used as closet doors, window shutters, or the like, and cooperates with the inner panels of the two bifold door assemblies. Further, the system disclosed in this patent does not operate automatically as a part of the door opening and closing operation.

Another example of a latching mechanism is disclosed in U.S. Pat. No. 4,637,446 issued to McQueen et al. on Jan. 20, 1987, which shows a spring biased latching system. The system disclosed in this patent shows a latch member that engages a catchplate mounted on the door track. Opening and closing of the door is done manually, however, with a lift cable being used to disengage the latch member from the catchplate.

The automatic latching mechanism of the present invention overcomes the difficulties described above and affords other features and advantages heretofore not available.

SUMMARY OF THE INVENTION

The invention includes a latching assembly and an activation assembly. The latching assembly includes a latch arm that cooperates with a latch member fixed to an adjacent door jamb. The actuation assembly is driven by an electric motor that also serves to open and close the overhead bifold door. As the bifold door reaches its vertical, closed position, the actuation assembly pulls a cable that overcomes the resistance of a backspring, allowing the latch arm to be pulled into a locking relationship with the roller fixed to the door jamb.

It is an object of the invention to provide a secure latching mechanism for very large size overhead bifold doors. It is a further object of the invention to provide a latching mechanism that performs the unlatching and latching operations automatically in cooperation with the opening and closing of the overhead bifold door.

It is a further object of the invention that the entire opening, closing and latching operations be performed automatically by engaging a single electric motor.

Other objects and advantages of the invention will become apparent from the following detailed description and from the appended drawings in which like numbers have been used to describe like parts throughout the several views.

BRIEF DESCRIPTION OF THE DRAWINGS

FIG. 1 shows a perspective view of the outside of a typical structure having an overhead bifold door in its vertical, closed position;

FIG. 2 shows a cutaway view taken along line 2—2 of FIG. 1 showing an end view of the automatic jamb latch mechanism in the fully latched position;

FIG. 3 shows a view similar to that of FIG. 2 but with the door somewhat opened and the automatic jamb latch in the unlatched position, including a partially cutaway view of the latch assembly;

FIG. 4 shows a view similar to that of FIG. 3 but with the overhead bifold door in its fully open position;

DESCRIPTION OF THE PREFERRED EMBODIMENT

Figure 5:
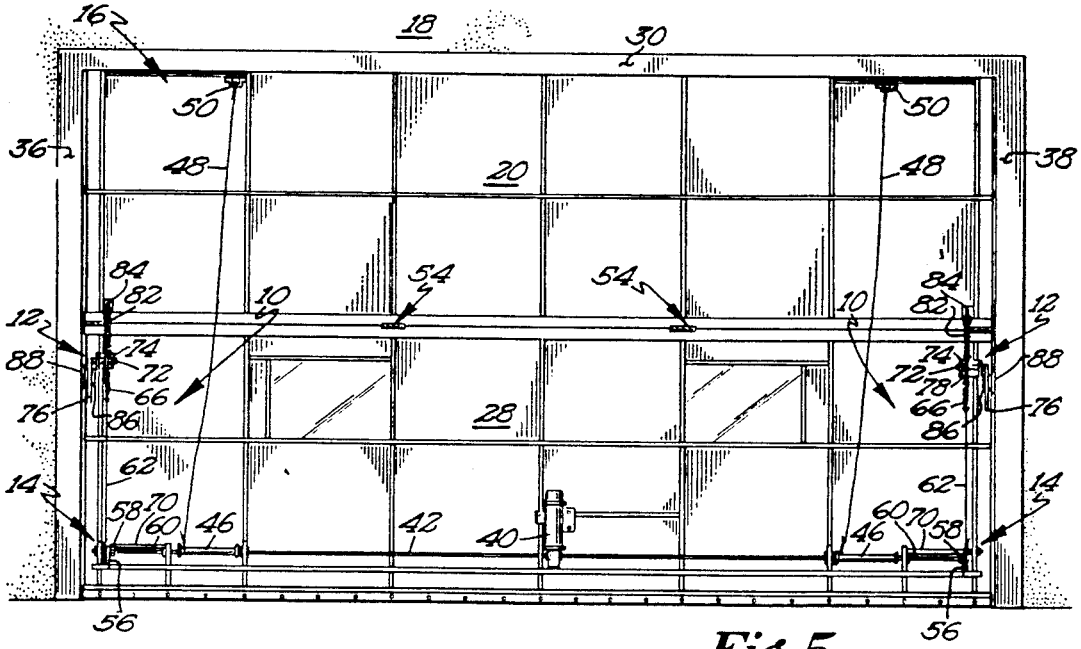
FIG. 5 shows a rear view of the overhead bifold door in its closed, vertical position, with an automatic jamb latch mechanism installed on both ends of the overhead bifold door.
Figure 8:
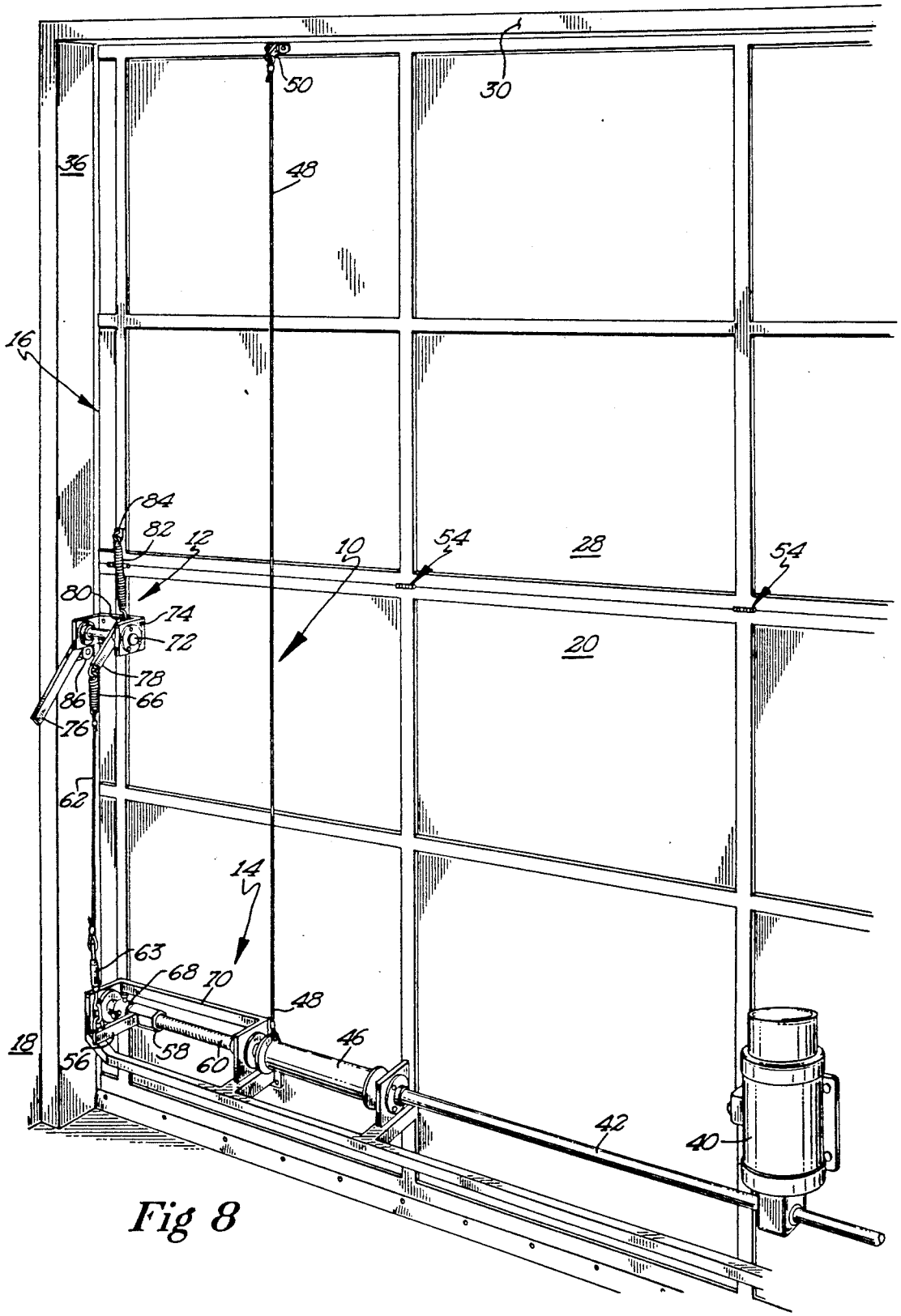
FIG. 8 shows a perspective view of the automatic jamb latch mechanism mounted on an overhead bifold door with the door in its vertical, closed position and the latch in its latched position.

With reference to the drawings, and in particular to FIG. 8, the automatic jamb latch mechanism for an overhead bifold door is generally indicated by reference numeral 10. Jamb latch mechanism 10 includes a latch arm assembly 12 and an actuation assembly 14. In its preferred embodiment, jamb latch mechanism 10 is mounted on the inside surface of an overhead bifold door 16 covering an opening to a garage or other utility building 18 (FIG. 1). Jamb latch mechanism 10 is preferably mounted to the first or lower panel 20 of overhead bifold door 16, although embodiments are envisioned that include a jamb latch mechanism 10 on both panels of overhead door 16. Further, jamb latch mechanism 10 may include latch arm assemblies 12 located on both ends of overhead bifold door (FIG. 5), in which case actuation assemblies 14 are required for each latch arm assembly 12. Yet a third latch arm assembly 12 may be provided, mounted to the upper panel 28 of overhead bifold door 16. A third latch arm assembly 12 so described may be actuated by means of an actuation assembly 14 already provided for one of the first two latch arm assemblies 12.

Overhead bifold door 16 may be attached to building 18 by any number of means, including by hinge means 22 that includes first attachment plate 24 and second attachment plate 26, as shown in FIGS. 4–6 and 8. First attachment plate 24 is fixedly attached as by screws to the second or upper panel 28 of overhead bifold door 16, and second attachment plate 26 is fixedly attached as by screws to the lintel or horizontal header 30. In the embodiment shown, both lower corners of lower panel 20 include projecting therefrom rollers 32 that ride within tracks 34. One track 34 is mounted to first door jamb 36 and the other track 34 is mounted to second door jamb 38.

As shown in FIG. 8, an electric motor 40 is mounted to lower panel 20 of overhead bifold door 16. The preferred embodiment of this device includes motor 40 to raise and lower overhead bifold door 16, although a manual winch system may be substituted for the motor. Further, motor 40 may be mounted to upper panel 28, lintel 30 or an interior wall portion of building 18 above or otherwise adjacent to overhead bifold door 16. Overhead bifold door 16 is raised when a switch mounted on an interior wall surface of building 18 is turned to start motor 40. Motor 40 then rotates power shaft 42 in the direction of arrow 44 (FIG. 6), which in turn rotates take-up shaft 46, which is a coaxial extension of power shaft 42. Take-up cable 48, an end of which may be fixedly attached to an upper portion of overhead bifold door 16, as at hook 50 projecting from first attachment plate 24 (FIGS. 2 and 4), is then wound around take-up shaft 46, and the lower edge of overhead bifold door 16 is raised in the direction of arrow 52 (FIG. 6), causing panels 20 and 28 to fold about hinges 54, fastened to upper panel 28 and lower panel 20. Hinge means 54 may include a pivot extending inward from the panels, mounted to hinge extension brackets 55 (FIGS. 2–4), as taught in U.S. Pat. No. 4,609,027, issued to Keller on Sep. 2, 1986. Such a modification serves to maximize the clearance between overhead bifold door 16 and the surface beneath, such as a garage floor, when overhead bifold door 16 is in its fully open position as shown in FIG. 4 by permitting lower door panel 20 and upper door panel 28 to approach a generally parallel relationship when open.

Figure 6:
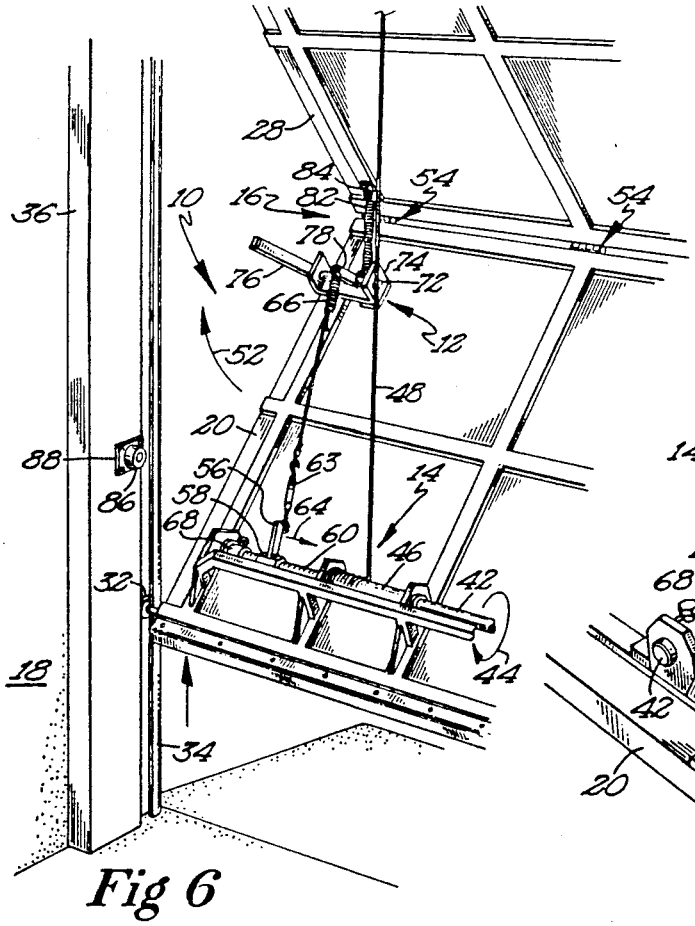
FIG. 6 shows a rear perspective view of the automatic jamb latch mechanism mounted on an overhead bifold door as the door is being opened.
Figure 7:
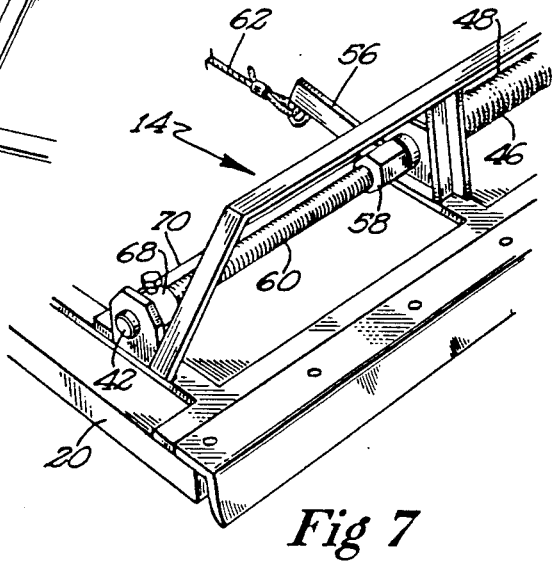
FIG. 7 shows a fragmentary, perspective view of the actuation assembly of the automatic jamb latch mechanism.

Actuation assembly 14 of jamb latch mechanism 10 also uses motor 40 to actuate latch arm assembly 12. As shown in FIGS. 6–8, actuation assembly 14 includes an arm 56 projecting from a threaded nut 58. Threaded nut 58 is threadedly engaged with threaded rod 60, a coaxial extension of power shaft 42 and take-up shaft 46. Thus, as motor 40 rotates power shaft 42 and take-up shaft 46, it simultaneously rotates threaded rod 60. Each of these three rod segments—i.e., power shaft 42, take-up shaft 46 and threaded rod 60—rotates in the same direction, as, for example, indicated by direction arrow 44. To the end of arm 56 is attached connecting means 62, the other end of which is attached to latch arm assembly 12. With overhead bifold door 16 in its open position (FIG. 4), motor 40 rotates power shaft 42 in the direction opposite to that indicated by direction arrow 44 (FIG. 6) to bring overhead bifold door 16 to its closed position. As threaded rod 60 rotates, threaded nut 58 moves along rod 60 in a direction opposite to that indicated by direction arrow 64 (FIG. 6), moving, for example, from right to left when configured as illustrated in FIG. 6. Ar 56 is maintained in its upward extending position as it travels along threaded rod 60, as shown, for example, in FIG. 6, because of the upward tension caused by coil spring member 66, integral with connecting means 62. (Connecting means 62 also preferably includes a metal cable, and may further include an adjustment leader 63 permitting the length of connecting means 62 to be easily lengthened or shortened.) Upon reaching the end of threaded rod 60, threaded nut 58 encounters stop 68, which is fixedly attached to and rotates with threaded rod 60. Stop 68, also coaxial with power shaft 42, now causes threaded nut 58 to rotate with threaded rod 60 approximately one quarter to one half rotation, which in turn causes arm 56 to rotate downwardly to the position shown in FIG. 8. The length of travel of threaded nut 58 along threaded rod 60 is so measured that threaded nut 58 encounters and travels with stop 68 at the very end of the closing cycle of overhead bifold door 16. As will be described hereinafter, the rotation of threaded nut 58 and the resulting travel of arm 56, which overcomes the resistance of coil spring member 66, actuates latch arm assembly 12, causing overhead bifold door 16 to become securely locked in a closed position, as shown in FIG. 8.

Upon beginning the cycle that results in moving overhead bifold door 16 to the open position, motor 40 rotates power shaft 42 in the direction indicated by arrow 44, causing threaded rod 60 also to rotate in the direction indicated by arrow 44. Threaded nut 58 and arm 56 also rotate with threaded rod 60, until arm 56 contacts bumper plate 70 (FIGS. 7 and 8). Upon striking bumper plate 70, arm 56 and threaded nut 58 therewith break contact with stop 68, and thereafter travel along threaded rod 60 in the direction indicated by arrow 64 (FIG. 6). As threaded nut 58 and arm 56 rotate with stop 68 to the position indicated in FIG. 6, latch arm assembly 12 is released, and overhead bifold door 16 is free to move to its open position. (See, FIGS. 2–4.)

Referring to FIGS. 6 and 8, latch arm assembly 12 includes a latch shaft 72 rotatably mounted to latch bracket 74, which is fixedly attached to lower panel 20 near first or second door jamb 36, 38, to maintain a distance of at least 1½ to two inches between latch shaft 72 and any structure immediately behind it, such as lower panel 20 or the front of any lateral portion such as a crossbar on latch bracket 74. An end of latch shaft 72, this being the end thereof nearest the adjacent door jamb 36, 38, projects beyond the projecting portions of latch bracket 74, and mounted to this end is latch arm 76. Also mounted to latch shaft 72, between the projecting portions of latch bracket 74 to which latch shaft 72 is mounted, are oppositely extending first tensioning arm 78 and second tensioning arm 80, most clearly shown in FIG. 3. The second or upper end of connecting means 62 is attached to first tensioning arm 78. In the preferred embodiment, first tensioning arm 78 is generally parallel to latch arm 76, but this is not required for the proper operation of latch arm assembly 12. Second tensioning arm 80 preferably projects generally rearwardly from latch shaft 72, and attached to a receiving portion thereon spaced from latch shaft 72, near the end of second tensioning arm 80, is an end of backspring 82. The second end of backspring 82 is attached to anchor 84, which, in its preferred embodiment, is fixedly mounted to upper door panel 28. Alternatively, anchor 84 may be attached to lower door panel 20. However, when so attached backspring 82 exerts a rearward force on second tensioning arm 80, resulting in the outward projection of latch arm 76, which, when overhead bifold door 16 is being opened, may cause damage to upper panel 28 unless a special deflecting plate (not shown) is added.

Attached to the door jamb 36, 38 adjacent latch arm assembly 12 for cooperative engagement therewith is a latch member that may preferably take the form of a rotatable metal roller 86. In the preferred embodiment, roller 86 is mounted to a roller shaft (not shown) projecting from a plate 88.

In use, electric motor 40 is activated, for example, by a wall-mounted switch (not shown) located on an interior wall surface of building 18. Assuming overhead bifold door 16 is in the open position, as indicated in FIG. 4, power shaft 42 rotates in a direction opposite to that indicated by arrow 44 in FIG. 6, causing take-up cable 48 to be unwound from take-up shaft 46. Simultaneously, threaded nut 58 is in the position illustrated in FIG. 7 when overhead bifold door 16 is in its open position, and the rotation of power shaft 42 causes threaded rod 60 to rotate in the same direction. The rotation of threaded rod 60, combined with the upward directed tension of spring member 66 of connecting means 62 attached to arm 56 of threaded nut 58, causes threaded nut 58 to move along threaded rod 60 toward stop 68.

As overhead bifold door 16 completes the closing cycle, threaded nut 58 contacts stop 68, causing threaded nut 58 to rotate with threaded rod 60 approximately one quarter to one half rotation. Electric motor 40 then stops running, as overhead bifold door 16 is now closed. However, as threaded nut 58 rotates with threaded rod 60 after contacting stop 68, arm 56 pulls down on connecting means 62, overcoming the upward directed tension of spring member 66 and backspring 82. The downward motion of arm 56 overcomes the resistance of backspring 82 and causes a similar downward motion in first tensioning arm 78, resulting in the rotation of latch shaft 72, causing the upward motion of second tensioning arm 80 and the corresponding downward motion of latch arm 76. The downward motion of latch arm 76 to the position shown in FIG. 8 completes the latching cycle of latch arm assembly 12. With roller 86 now positioned between latch arm 76 and lower panel 20 of overhead bifold door 16, overhead bifold door 16 is securely prevented from opening until motor 40 is reactivated starting the opening cycle of overhead bifold door 16.

The opening cycle of overhead bifold door 16 is largely the reverse of the closing cycle, with motor 40 rotating power shaft 42 in the direction indicated by arrow 44 in FIG. 6, causing take-up cable 48 to be wound onto take-up shaft 46. It is important to note that upon the first one quarter to one half rotation of threaded nut 58, until arm 56 contacts bumper plate 70, it is the tension of backspring 82 pulling down on second tensioning arm 80 that causes latch arm 76 to rise from the position shown in FIG. 2 to the position shown in FIG. 3, thus permitting overhead bifold door 16 to return to its open position. Further, as overhead bifold door 16 approaches the fully open position illustrated in FIG. 4, the tension in backspring 82 is relaxed, allowing latch arm 76 to settle generally parallel to lower and upper door panels 20, 28, respectively.

While the preferred embodiments of the invention have been described, it should be understood that various changes, adaptations, and modifications may be made therein without departing from the spirit of the invention and the scope of the appended claims.

What is claimed is:

1. A latch mechanism for use with an attachable to an overhead bifold door movable between open and closed positions over a doorway, the doorway having a first door jamb and a second door jamb and the overhead bifold door having a first door panel and a second door panel hingedly attached to each other, the latch mechanism comprising:

a latch arm assembly, including a movable latch arm, attachable to the first door panel of the overhead bifold door adjacent the first door jamb of the doorway, said latch arm assembly having a first, latched position and a second, unlatched position of said latch arm when attached to the first door panel of the overhead bifold door;

a latch member attachable to the first door jamb, and positioned for selective, cooperative engagement with said latch arm;

an actuation means attachable to the first door panel of the overhead bifold door for operative activation of said latch arm assembly between said latched and unlatched positions and for moving said latch arm into latching relation to said latch member;

a connecting means linking said actuation means and said latch arm assembly;

a power source for driving the latch mechanism; and power transmission means between said power source and said actuation means.

2. A latch mechanism as recited in claim 1, wherein: said power source is a motor.

3. A latch mechanism as recited in claim 2, wherein: said motor is mounted to the first door panel of the overhead bifold door.

4. A latch mechanism as recited in claim 1, wherein said latch arm assembly comprises:

a rotatable latching shaft rotatably mounted on said first door panel of the overhead bifold door, said latching shaft having a generally horizontal orientation, and said latch arm being attached to said latching shaft for rotatable movement therewith; and biasing means operatively associated with said latching shaft and normally rotatably biasing said latching shaft to said unlatched position wherein said latch arm is held out of latching relation to said latch member, and said connecting means being operatively connected to said latching shaft to overcome said biasing means in response to operation of said actuation means to rotate said latch arm to said latched position.

5. A latch mechanism as recited in claim 4 wherein said latch arm assembly further comprises:

a first tensioning arm fixedly mounted to said rotatable latching shaft and projecting therefrom, said first tensioning arm having a receiving portion spaced from said rotatable latching shaft to which said connecting means is attached;

said biasing means comprises a backspring having a first end and a second end, said first end of said backspring fixedly mounted to the second door panel of the overhead bifold door; and a second tensioning arm fixedly mounted to said rotatable latching shaft and projecting therefrom, said second tensioning arm having a receiving portion spaced from said rotatable latching shaft to which said second end of said backspring attaches.

6. A latch mechanism as recited in claim 1, wherein:

said power transmission means includes a power shaft having a first end and a second end, said first end of said power shaft being connected to said power source; and said actuation means is mounted to said second end of said power shaft.

7. A latch mechanism as recited in claim 6, wherein said actuation means comprises:

a cylindrical threaded portion having a first end and a second end, said cylindrical threaded portion being coaxial with said power shaft;

a threaded nut that travels along said cylindrical threaded portion;

a connecting arm projecting from said threaded nut, said connecting arm being attached to said connecting means; and a stopping segment near an end of said cylindrical threaded portion, whereby when said power shaft rotates, said threaded nut travels along said cylindrical threaded portion until it confronts said stopping segment, after which said threaded nut rotates with said power shaft.

8. A latch mechanism as recited in claim 1 wherein: said latch member is a roller.

9. A latch mechanism as recited in claim 1, further comprising:

a secondary latch arm assembly, including a secondary movable latch arm, attached to the first door panel of the overhead bifold door adjacent the second door jamb of the doorway, said secondary latch arm assembly having a first, latched position and a second, unlatched position of said secondary latch arm;

a secondary latch member attached to the second door jamb, and positioned for selective, cooperative engagement with said secondary latch arm;

a secondary actuation means attached to the first door panel of the overhead bifold door for operative activation of said secondary latch arm assembly between said latched and unlatched positions and for moving said secondary latch arm into latching relation to said secondary latch member;

a secondary connecting means linking said secondary actuation means and said secondary latch arm assembly; and secondary power transmission means between said power source and said secondary actuation means.

10. A latch mechanism for use with and mountable to an overhead bifold door for a doorway, the doorway having a first door jamb and a second door jamb and the overhead bifold door having a first door panel and a second door panel, the overhead bifold door being movable to a first, closed position during a closing cycle, the overhead bifold door being movable to a second, open position during an opening cycle, and a motorized drive means for moving the overhead bifold door between the first, closed position and the second, open position, the latch mechanism comprising:

door latching means mountable to the first door panel of the overhead bifold door and movable between latching and unlatched positions when mounted to the first door panel of the overhead bifold door;

a latch member cooperative with said door latching means, said latch member being mountable to the first door jamb of the doorway;

actuating means operatively connected between the motorized drive means and said door latching means to be driven by the drive means; and first connecting means between the overhead bifold door and the motorized drive means, whereby when the motorized drive means moves the overhead bifold door to its first, closed position, from its second, open position, by way of said first connecting means, said actuating means simultaneously activates said door latching means to said latching position, and when the motorized drive means moves the overhead bifold door to its second, open position from its first, closed position, by way of said first connecting means, said actuating means simultaneously releases said door latching means to said unlatched position.

11. A latch mechanism as recited in claim 10, wherein said door latching means comprises:

a latch arm assembly movable between said latching and unlatched positions.

12. A latch mechanism as recited in claim 11, wherein said actuating means comprises:

a power shaft having a first end and a second end, said first end being connected to the motorized drive means, and said second end including an actuation portion; and second connecting means linking said latch arm assembly and said actuation portion of said power shaft, whereby upon completing the closing cycle bringing the overhead bifold door to its first, closed position, said actuating means moves said latch arm assembly to its said latching position, by way of said second connecting means, and upon beginning the opening cycle bringing the overhead bifold door to its second, open position, said actuating means moves said latch arm assembly to its said unlatched position, by way of said second connecting means.

13. A latch mechanism as recited in claim 12, wherein said actuation portion of said power shaft comprises:

a cylindrical threaded portion having a first end and a second end, said cylindrical threaded portion being coaxial with said power shaft;

a threaded nut that travels along said cylindrical threaded portion;

a connecting arm projecting from said threaded nut, said connecting arm being attached to said connecting means; and a stopping segment near an end of and fixedly attached to said cylindrical threaded portion, whereby when said power shaft rotates, said threaded nut travels along said cylindrical threaded portion until it confronts said stopping segment, after which said threaded nut rotates with said power shaft.

14. A latch mechanism as recited in claim 13, wherein said latch arm assembly comprises:

a rotatable latching shaft mounted on brackets attached to the first door panel of the overhead bifold door, said latching shaft having a generally horizontal orientation;

a latch arm attached to said latching shaft, said latch arm being mounted near an end of said latching shaft and generally perpendicular to the axis thereof;

a first tensioning arm fixedly mounted to said rotatable latching shaft and projecting therefrom, said first tensioning arm having a receiving portion spaced from said rotatable latching shaft to which said second connecting means attaches;

a backspring having a first end and a second end, said first end of said backspring fixedly mounted to the second door panel of the overhead bifold door; and a second tensioning arm fixedly mounted to said rotatable latching shaft and projecting therefrom, said second tensioning arm having a receiving portion spaced from said rotatable latching shaft to which said second end of said backspring attaches.

15. A latch mechanism as recited in claim 14, wherein:

the motorized drive means is mounted to the first door panel of the overhead bifold door.

16. A latch mechanism for use with and mountable to an overhead bifold door for a doorway, the doorway having a first door jamb and a second door jamb and the overhead bifold door having a first door panel and a second door panel, the overhead bifold door being movable to a first, closed position during a closing cycle, the overhead bifold door being movable to a second, open position during an opening cycle, and a drive means for moving the overhead bifold door between the first, closed position and the second, open position, the latch mechanism comprising:

door latching means mountable to the first door panel of the overhead bifold door and movable between latching and unlatched positions when mounted to the first door panel o the overhead bifold door;

a latch member cooperative with said door latching means, said latch member being mountable to the first door jamb of the doorway;

actuating means operatively connected between the drive means and said door latching means to be driven by the driven means; and first connecting means between the overhead bifold door and the drive means, whereby when the drive means moves the overhead bifold door to its first, closed position, from its second, open position, by way of said first connecting means, said actuating means simultaneously activates said door latching means to said latching position, and when the drive means moves the overhead bifold door to its second, open position form its first, closed position, by way of said first connecting means, said actuating means simultaneously releases said door latching means to said unlatched position.

17. A latch mechanism as recited in claim 16, wherein said door latching means comprises:

a latch arm assembly movable between said latching and unlatched positions.

18. A latch mechanism as recited in claim 17, wherein said actuating means comprises:

a power shaft having a first end and a second end, said first end being connected to the drive means, and said second end including an actuation portion; and second connecting means linking said latch arm assembly and said actuation portion of said power shaft, whereby upon completing the closing cycle bringing the overhead bifold door to its first, closed position, said actuating means moves said latch arm assembly to said latching position, by way of said second connecting means, and upon beginning the opening cycle bringing the overhead bifold door to its second, open position, said actuating means moves said latch arm assembly to said unlatched position, by way of said second connecting means.

19. A latch mechanism as recited in claim 18, wherein said actuation portion comprises:

a cylindrical threaded portion having a first end and a second end, said cylindrical threaded portion being coaxial with said power shaft;

a threaded nut that travels along said cylindrical threaded portion;

a connecting arm projecting from said threaded nut, said connecting arm being attached to said connecting means; and a stopping segment near an end of and fixedly attached to said cylindrical threaded portion, whereby when said power shaft rotates, said threaded nut travels along said cylindrical threaded portion until it confronts said stopping segment after which said threaded nut rotates with said power shaft.

20. A latch mechanism as recited in claim 19, wherein said latch arm assembly comprises:

a rotatable latching shaft mounted on brackets attached to the first door panel of the overhead bifold door, said latching shaft having a generally horizontal orientation;

a latch arm attached to said latching shaft, said latch arm being mounted near an end of said latching shaft and generally perpendicular to the axis thereof;

a first tensioning arm fixedly mounted to said rotatable latching shaft and projecting therefrom, said first tensioning arm having a receiving portion spaced from said rotatable latching shaft to which said second connecting means attaches;

a backspring having a first end and a second end, said first end of said backspring fixedly mounted to the second door panel of the overhead bifold door; and a second tensioning arm fixedly mounted to said rotatable latching shaft and projecting therefrom, said second tensioning arm having a receiving portion spaced from said rotatable latching shaft to which said second end of said backspring attaches.

21. A latch mechanism as recited in claim 20, wherein:

the drive means comprises a motor mounted to the first door panel of the overhead bifold door.

22. A latch mechanism in combination with an overhead bifold door movable between open and closed positions over a doorway, the doorway having a first door jamb and a second door jamb and the overhead bifold door having a first door panel and a second door panel hingedly attached to each other, the latch mechanism comprising:

a latch arm assembly, including a movable latch arm, attached to the first door panel of the overhead bifold door adjacent the first door jamb of the doorway, said latch arm assembly having a first, latched position and a second, unlatched position of said latch arm;

a latch member attached to the first door jamb, and positioned for selective, cooperative engagement with said latch arm;

an actuation means attached to the first door panel of the overhead bifold door for operative activation of said latch arm assembly between said latched and unlatched positions and for moving said latch arm into latching relation to said latch member;

a connecting means linking said actuation means and said latch arm assembly;

a power source for driving the latch mechanism; and power transmission means between said power source and said actuation means.

23. A latch mechanism in combination with an overhead bifold door for a doorway, the doorway having a firs door jamb and a second door jamb and the overhead bifold door having a first door panel and a second door panel, the overhead bifold door being movable to a first, closed position during a closing cycle, the overhead bifold door being movable to a second, open position during an opening cycle, and a motorized drive means for moving the overhead bifold door between the first, closed position and the second, open position, the latch mechanism comprising:

door latching means mounted to the first door panel of the overhead bifold door and movable between latching and unlatched positions;

a latch member cooperative with said door latching means, said latch member being mounted to the first door jamb of the doorway;

actuating means operatively connected between the motorized drive means and said door latching means to be driven by the drive means; and first connecting means between the overhead bifold door and the motorized drive means, whereby when the motorized drive means moves the overhead bifold door to its first, closed position, from its second, open position, by way of said first connecting means, said actuating means simultaneously activates said door latching means to said latching position, and when the motorized drive means moves the overhead bifold door to its second, open position from its first, closed position, by way of said first connecting means, said actuating means simultaneously releases said door latching means to said unlatched position.

24. A latch mechanism in combination with an overhead bifold door for a doorway, the doorway having a first door jamb and a second door jamb and the overhead bifold door having a first door panel and a second door panel, the overhead bifold door being movable to a first, closed position during a closing cycle, the overhead bifold door being movable to a second, open position during an opening cycle, and a drive means for moving the overhead bifold door between the first, closed position and the second, open position, the latch mechanism comprising:

door latching means mounted to the first door panel of the overhead bifold door and movable between latching and unlatched positions;

a latch member cooperative with said door latching means, said latch member being mounted to the first door jamb of the doorway;

actuating means operatively connected between the drive means and said door latching means to be driven by the drive means; and first connecting means between the overhead bifold door and the drive means, whereby when the drive means moves the overhead bifold door to its first, closed position, from its second, open position, by way of said first connecting means, said actuating means simultaneously activates said door latching means to said latching position, and when the drive means moves the overhead bifold door to its second, open position from its first, closed position, by way of said first connecting means, said actuating means simultaneously releases said door latching means to said unlatched position.

* * * * *

UNITED STATES PATENT AND TRADEMARK OFFICE

CERTIFICATE OF CORRECTION

PATENT NO. : 5,168,914
DATED : December 8, 1992
INVENTOR(S) : Keller, Daniel N.

It is certified that error appears in the above-indentified patent and that said Letters Patent is hereby corrected as shown below:

Col. 3, line 67, delete "AR" and substitute --Arm--therefor.
Col. 6, claim 1, line 2, delete "an" and substitute --and therefor. (first occurrence).
Col. 9, claim 16, line 27, after "panel" delete "o" and substitute --of --therefor.
Col. 9, claim 16, line 33, delete the second "driven" and substitute --drive-therefor.
Col. 10, claim 19,line 18, after the word "segment" insert --,--.
Col. 11, claim 23, line 3, delete "firs" and substitute--first--therefor.

Signed and Sealed this

Eleventh Day of January, 1994

*Attest:*

Bruce Lehman

BRUCE LEHMAN

*Attesting Officer*

*Commissioner of Patents and Trademarks*